US007622152B2

(12) United States Patent
Kim et al.

(10) Patent No.: US 7,622,152 B2
(45) Date of Patent: Nov. 24, 2009

(54) $MOSI_2$-$SI_3N_4$ COMPOSITE COATING AND MANUFACTURING METHOD THEREOF

(75) Inventors: Jae Soo Kim, Seoul (KR); Kyeung Ho Kim, Seoul (KR); Ji Young Byun, Seoul (KR); Jin-Kook Yoon, Seoul (KR); Doo Yong Kim, Seoul (KR); Jong Kown Lee, Suwon (KR); Jong Chul Shin, Seoul (KR); Dae Ho Rho, Jeonju (KR)

(73) Assignee: Korea Institute of Science and Technology, Seoul (KR)

( * ) Notice: Subject to any disclaimer, the term of this patent is extended or adjusted under 35 U.S.C. 154(b) by 109 days.

(21) Appl. No.: 11/482,840

(22) Filed: Jul. 10, 2006

(65) Prior Publication Data

US 2006/0251912 A1 Nov. 9, 2006

Related U.S. Application Data

(62) Division of application No. 10/337,367, filed on Jan. 7, 2003, now abandoned.

(30) Foreign Application Priority Data

Mar. 20, 2002 (KR) ..... 2002/13914

(51) Int. Cl.

| | |
|---|---|
| ***C23C 16/00*** | (2006.01) |
| *C23C 16/26* | (2006.01) |
| *B05D 1/40* | (2006.01) |
| *B05D 3/02* | (2006.01) |
| *B05D 3/04* | (2006.01) |

(52) U.S. Cl. ..... 427/248.1; 427/255.11; 427/255.15; 427/255.18; 427/255.7; 427/331; 427/372.2; 427/377

(58) Field of Classification Search ..... None
See application file for complete search history.

(56) References Cited

U.S. PATENT DOCUMENTS

| | | | | |
|---|---|---|---|---|
| 2,865,088 | A | 12/1958 | Yntema et al. | |
| 5,429,997 | A | 7/1995 | Hebsur | |
| 5,472,487 | A | 12/1995 | Chin et al. | |
| 5,990,025 | A | 11/1999 | Suyama et al. | |
| 6,200,691 | B1 * | 3/2001 | Moore et al. | 428/615 |
| 6,211,496 | B1 | 4/2001 | Jiang | |
| 6,265,080 | B1 | 7/2001 | Maloney et al. | |
| 6,288,000 | B1 | 9/2001 | Hebsur | |

FOREIGN PATENT DOCUMENTS

| | | |
|---|---|---|
| DE | 1 960 836 | 6/1971 |
| FR | 3J237970/5.21 | 12/2003 |

OTHER PUBLICATIONS

Yoon et al. Formation of MoSi2-Si3N4 composite coating by reactive diffusion of Si on Mo substrate pretreated by ammonia nitradation. Scripta Materials 47 (2002) pp. 249-253.*

(Continued)

*Primary Examiner*—Timothy Meeks
*Assistant Examiner*—Kelly M Gambetta
(74) *Attorney, Agent, or Firm*—Darby & Darby PC

(57) ABSTRACT

A $MoSi_2$—$Si_3N_4$ composite coating which is coated on a surface of base materials. The $MoSi_2$—$Si_3N_4$ composite coating on the surface of the base material can be formed by forming a $Mo_2N$ diffusion layer by vapor-depositing of nitrogen on the surface of the base material and forming a $MoSi_2$—$Si_3N_4$ composite coating by vapor-depositing of silicon on the surface of the $Mo_2N$ diffusion layer, or the $MoSi_2$—$Si_3N_4$ composite coating on the surface of the base material can be formed by forming a $MoSi_2$ diffusion layer by vapor-depositing of silicon on a surface of a base material by the CVD method, transforming the $MoSi_2$ diffusion layer into a $Mo_5Si_3$ diffusion layer by heating under a high-purity hydrogen or argon atmosphere, forming a $MoSi_2$—$Si_3N_4$ composite diffusion layer by vapor-depositing of nitrogen on the surface of the $MosSi_3$ diffusion layer by the CVD method and forming a $MoSi_2$—$Si_3N_4$ composite coating by vapor-depositing of silicon on the surface of the $MoSi_2$—$Si_3N_4$ composite diffusion layer.

8 Claims, 4 Drawing Sheets

OTHER PUBLICATIONS

Hirvonen, et al. Microstructure and mechanical properties of nitrided molybdenum silicide coatings. Materials Research Society Symposium Proceedings, Feb. 2004.*

Liu et al. Thermodynamic reassessment of the Mo-Si and Al-Mo-Si systems. Intermetallics 8 (2000) pp. 953-962.*

Bartlett et al. (Mar. 15, 1998). "Elevated temperature mechanical properties of $MoSi_2/Si_3N_4$, $MoSi_2/Si$ composites produced by self-propagating high temperature synthesis," *Journal of Materials Science* 33(6):1653-1660.

Cockeram et al. (Mar. 24, 1995). "Preventing the accelerated low-temperature oxidation of $MoSi_2$ (pesting) by the application of superficial alkali-salt layers," *Oxidation of Metals* 45(1/2):77-108.

Hebsur, Mohan G. (1999). "Development and characterization of $SiC_{(f)}/MoSi_2$-$Si_3N_{4(p)}$ hybrid composites," *Materials Science and Engineering* A261:24-37.

Hsieh et al. (Apr. 1997). "The effect of $Si_2N_4$ on the thermal expansion behavior of $MoSi_2$," *Materials Letters* 30(5-6):407-410.

French Search Report dated Nov. 25, 2003, directed to a counterpart French application.

Yoon et al. (Aug. 2002). "Formation of $MoSi_2$-$Si_3N_4$ composite coating by reactive diffusion of Si on Mo substrate pretreated with ammonia nitridation." *Scipta Materiala* 47(4):1359-1462.

* cited by examiner

$MOSI_2$-$SI_3N_4$ COMPOSITE COATING AND MANUFACTURING METHOD THEREOF

CROSS-REFERENCE TO RELATED APPLICATION

This application is a divisional of U.S. application Ser. No. 10/337,367, filed Jan. 7, 2003, which is incorporated herein by reference.

BACKGROUND OF THE INVENTION

1. Field of the Invention

The present invention relates to a coating having excellent oxidation resistance and corrosion resistance, which is provided on the surface of metals such as molybdenum, niobium and their alloys, and manufacturing method thereof.

2. Description of the Background Art

Due to properties of low vapor pressure and thermal expansion coefficient, Molybdenum (Mo) having a melting point of 2617° C. maintains high strength and hardness at a high temperature, and has better high-temperature mechanical, thermal properties than any other metal. Accordingly, it is a core material which can be applied to fields of aerospace, atomic energy and the like.

However, the material has a disadvantage that it can be used only in a non-oxidizing condition since it forms volatile $MoO_3$ by reacting with oxygen at a low temperature of about 600° C.

On the other hand, since niobium (Nb) has a melting point of 2467° C., a density lower than that of molybdenum (Nb; 8.55 g/cm$^3$, Mo; 10.2 g/cm$^3$), and its high-temperature mechanical property is excellent as that of molybdenum, niobium or niobium alloys can be advantageously used as next-generation high-temperature structural materials. However, these materials also do not show high-temperature oxidation resistance.

To improve oxidation resistance of molybdenum or molybdenum alloys, methods such as surface coating treatment, by which $MoSi_2$ having an excellent oxidation resistance is coated on a molybdenum surface, have been widely used. In case of niobium or niobium alloys, to improve oxidation resistance, a surface coating treatment, which is similar to that for molybdenum and is performed after depositing molybdenum on the surface in a predetermined thickness, has been being studied.

In case of a slurry surfacing method among the surface coating treatments, the formation of an alloy coating can be easily performed, but a amount of defects, such as pore and the like can be formed.

In case of directly coating a $MoSi_2$ layer using a low-pressure plasma spraying method, the formation of the alloy coating is easily performed, but it is difficult to adjust the composition and to form $MoSi_2$ coating without a defect.

Therefore, reactive-diffusion methods such as pack-siliconizing, CVD, dipping of liquid silicon and the like are generally adopted as a coating treatment. The pack-siliconizing method and CVD method, in which the silicon diffuse under the condition of gas state and are deposited on the surface of the basic materials, are distinguished from the dipping method in which the silicon diffuse under the liquid condition.

Since a dense silicon dioxide ($SiO_2$) layer is formed on the surface of $MoSi_2$ layer and restrains movement of oxygen when the $MoSi_2$ layer coated on molybdenum or niobium is exposed to a high-temperature oxidation atmosphere, internal base materials can be protected.

However, thermal, mechanical limitation which are problematic for commercialization of $MoSi_2$ coating is affected by following three factors.

(1) interdiffusion between molybdenum or niobium and $MoSi_2$ coating, (2) thermal stress generated by a difference of thermal expansion coefficients between molybdenum ($5.1\times10^{-6}$/° C.) or niobium ($7.2\times10^{-6}$/° C.) and $MoSi_2$ coating ($9.5\times10^{-6}$/° C.), or between a difference of thermal expansion coefficients between $MoSi_2$ coating and $SiO_2$ layer ($0.5\times10^{-6}$/° C.), and (3) pest oxidation that the $MoSi_2$ coating is divided into $MoO_3$ and $SiO_2$, which is due to the rapid oxidation occurred in the atmosphere around 400~600° C. and accordingly, Therefore, in case of actually using molybdenum or niobium on which the $MoSi_2$ coating is coated, a life span of the coating varies according to the condition under which it is used.

In case of isothermal oxidation which occurs in a high temperature oxidation atmosphere, silicon is diffused into molybdenum by the interdiffusion between molybdenum and $MoSi_2$ coating, and, accordingly, the $MoSi_2$ coating with excellent oxidation resistance is transformed into a $Mo_5Si_3$ coating without oxidation resistance, which can not be used as a surface protecting coating anymore. Therefore, in this case, the maximum life span of $MoSi_2$ coating can be increased by increasing the thickness of it.

However, in case of cyclic oxidation occurring during the cyclic process of maintaining the above material in a high temperature oxidation atmosphere for a predetermined time and then cooling to a room temperature, when the temperature is raised to a high temperature, the micro crack in the coating is filled with silicon oxides formed from silicon within $MoSi_2$ coating (self-healing). On the other hand, when the coating is cooled to the room temperature, micro cracks are generated within the coating, due to the difference of thermal expansion coefficients between molybdenum or niobium and $MoSi_2$ coating and silicon oxide layers.

As the number of cyclic oxidation between high temperature and room temperature increases, the size of the micro crack increases. When the size reaches to a critical point, the crack can not be filled any more, and molybdenum or niobium is directly exposed to oxygen which exists in the atmosphere, thus causing rapid oxidation.

In addition, the other problem is that, in the atmosphere around 400~600° C., the $MoSi_2$ coating is rapidly oxidized into the powder types of molybdenum oxides ($MoO_x$) and silicon oxides. As described above, this kind of oxidation is called as pest oxidation.

Particularly, volume expansion of about 250%, which is occurred when $MoSi_2$ is oxidized at a low temperature into molybdenum oxides and silicon oxides, causes generation of a pore and a micro crack, and disintegration of the $MoSi_2$ coating into a powder type. Accordingly, the $MoSi_2$ coating get lost low-temperature oxidation resistance.

Therefore, the reason that commercialization of molybdenum or niobium coated with $MoSi_2$ is difficult is that it has no cyclic oxidation resistance at a high temperature and no low-temperature oxidation resistance.

To improve cyclic oxidation resistance and low-temperature oxidation resistance of molybdenum or niobium coated with a $MoSi_2$ layer, two conventional methods have been developed.

Firstly, there is a method for improving cyclic oxidation resistance by filling the crack. In this method, when an alloy element is added to the $MoSi_2$ coating, a silicon oxide layer which is formed in a high-temperature oxidation atmosphere is alloyed to reduce a difference in thermal expansion coefficient between $MoSi_2$ coating and silicon oxide layer. Accordingly, at the room temperature, the peeling of oxide layer is restrained, and the viscosity of silicon oxide layer is reduced, and thus the oxide layer smoothly slips down into the micro crack.

As an example of the above method, the U.S. Pat. No. 2,865,088 disclosed that the cyclic oxidation resistance could be improved by the addition of chrome (Cr), boron (B) and the like. And the German Patent No. 1,960,836 has reported that the cyclic oxidation resistance was improved about five times in case of adding germanium (Ge).

Secondly, according to B. V. Cockeram et al. reported in the Oxidation of Metals, vol. 45 (1996) p. 77~108, if sodium fluoride (NaF) is used as an activator in a manufacturing process of a $MoSi_2$ coating by a pack-siliconizing method, the sodium fluoride deposited on a surface of the coating layer has been known to be capable of improving low-temperature oxidation resistance of coating.

On the other hand, according to the disclosure of U.S. Pat. No. 5,472,487, when a properly mixed powder of $MoSi_2$, $SiO_2$, $Si_3N_4$, SiC and $Mo_5Si_3$ is coated by low-pressure plasma spraying on a niobium (Nb) metal having a thermal expansion coefficient of $7.9\times10^{-6}$/° C., the thermal expansion coefficient of a composite coating becomes lower than the thermal expansion coefficient of the pure $MoSi_2$ coating, and the peeling of the surface protecting oxidation coating or the composite coating are not observed even if cyclic oxidation tests in which the metal is heated for an hour in an oxidation atmosphere of 2500° F. (about 1371° C.) and then is maintained for 55 minutes in room temperature, are cycled about 10 or more times.

However, the devices of the low-pressure plasma spraying method cost very much, a plurality of defects such as pores and the like exist in the coating, and the method is limited to be used in manufacturing of a thick coating having a thickness of several mms.

On the other hand, methods for reducing thermal expansion coefficient of $MoSi_2$ sintered composite improving pest oxidation are also reported.

The U.S. Pat. No. 6,288,000 discloses that a thermal expansion coefficient of $MoSi_2$—$Si_3N_4$ sintered composite which was manufactured by hot-isostatic pressing of powder mixture formed by adding $MoSi_2$ powder and $Si_3N_4$ powder having volume ratios of about 30% and 50% is lower than the thermal expansion coefficient of monolithic $MoSi_2$ and is similar as that of Mo at 1000~1500° C.

The U.S. Pat. No. 5,429,997 disclosed that low-temperature oxidation resistance (in the atmosphere at 500° C.), high temperature isothermal oxidation resistance and cyclic oxidation resistance of $MoSi_2$—$Si_3N_4$ sintering which was manufactured by hot-isostatic pressing of powder mixture in which respectively $Si_3N_4$ powder having 30% and 45% of volume ratios is added is more excellent than in the case of monolithic $MoSi_2$.

FIG. 1 is a view showing a cross-sectional microstructure of $MoSi_2$—$Si_3N_4$ sintered composite manufactured by hot-isostatic pressing in the Materials Science and Engineering A261 (1999) p. 24-37 reported by Mohan G. Hebsur.

As shown in FIG. 1, the microstructure of the sintered composite is characterized in that the $Si_3N_4$ particles are irregularly formed in the $MoSi_2$ matrix. Therefore, the method was not efficient in preventing oxygen from diffusing through a $MoSi_2$ grain boundary into the layer by forming a $Si_2ON_2$ protection layer.

SUMMARY OF THE INVENTION

Therefore, an object of the present invention is to provide a $MoSi_2$—$Si_3N_4$ composite coating and a manufacturing method thereof, capable of improving cyclic oxidation resistance and low-temperature oxidation resistance of base materials which are molybden, molybden alloy, molybden-coated niobium or molybden-coated niobium alloy, and improving high-temperature mechanical property of a coating.

To achieve these and other advantages and in accordance with the purpose of the present invention, as embodied and broadly described herein, there is provided a $MoSi_2$—$Si_3N_4$ composite coating which is coated on a surface of base materials which are molybden, molybden alloy, molybden-coated niobium or molybden-coated niobium alloy, and has a structure that $Si_3N_4$ particles are distributed along $MoSi_2$ grain boundary of equiaxed grain.

Also, the present invention provides a manufacturing method of the $MoSi_2$—$Si_3N_4$ composite coating, including the steps of (a) forming a $Mo_2N$ diffusion layer by vapor-depositing of nitrogen on the surface of the base material, (b) forming a $MoSi_2$—$Si_3N_4$ composite coating by vapor-depositing of silicon on the surface of the $Mo_2N$ diffusion layer.

Also, the present invention provides a manufacturing method of the $MoSi_2$—$Si_3N_4$ composite coating, including the steps of (a) forming a $MoSi_2$ diffusion layer by vapor-depositing of silicon on the surface of the base material by the CVD method, (b) transforming the $MoSi_2$ diffusion layer into a $Mo_5Si_3$ diffusion layer by heating under a high-purity hydrogen or argon atmosphere, (c) forming a $Mo_2N$—$Si_3N_4$ composite diffusion layer by vapor-depositing of nitrogen on the surface of the $Mo_5Si_3$ diffusion layer by the CVD method, (d) forming a $MoSi_2$—$Si_3N_4$ composite coating by vapor-depositing of silicon on the surface of the $Mo_2N$—$Si_3N_4$ composite diffusion layer.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 2*a* and 2*b* are views showing a cross-sectional structure and a surface structure of the $MoSi_2$ coating having a columnar structure by the conventional manufacturing methods, such as a CVD method, pack-siliconizing method, dipping method and the like;

DETAILED DESCRIPTION OF THE PREFERRED EMBODIMENTS

Figure 1:
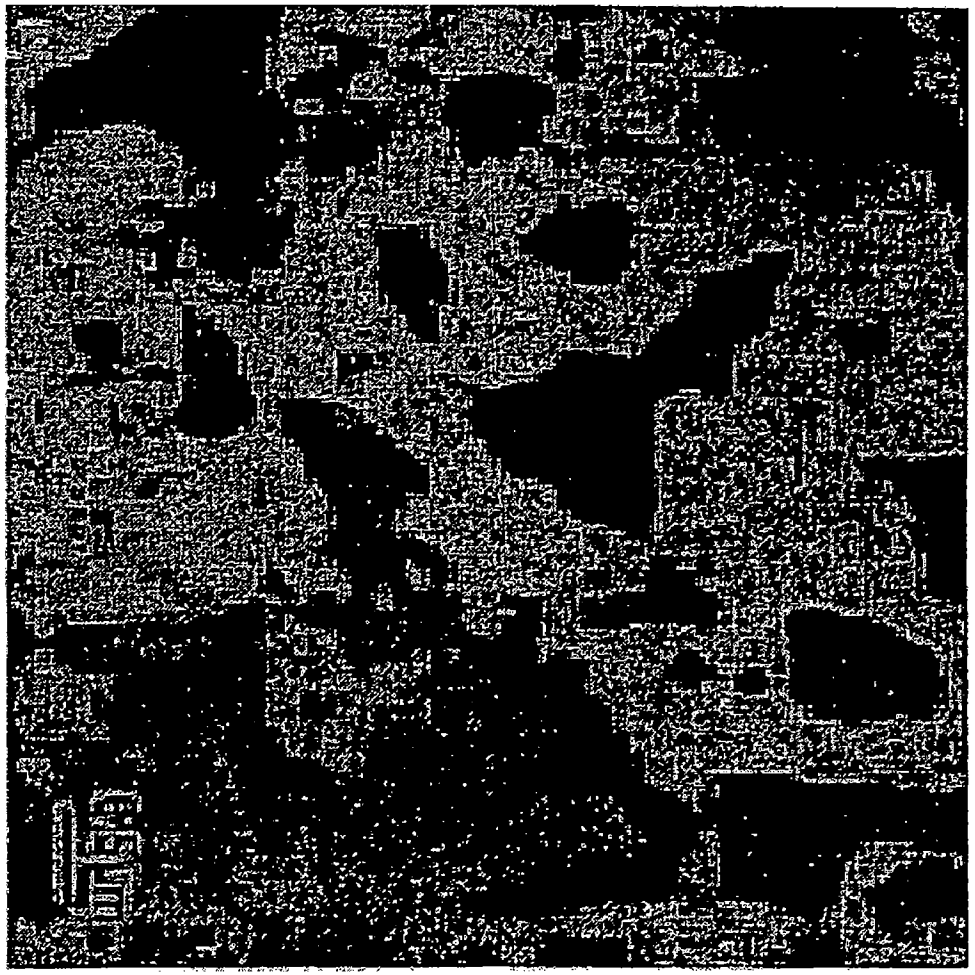
Fig. 1 Prior Art
FIG. 1 is a view showing a cross-sectional structure of $MoSi_2$—$Si_3N_4$ sintered composite manufactured by hot-isostatic pressing in the Materials Science and Engineering A261 (1999) p. 24-37 reported by Mohan G. Hebsur.

Reference will now be made in detail to the preferred embodiments of the present invention, examples of which are illustrated in the accompanying drawings.

Hereinafter, the $MoSi_2$—$Si_3N_4$ composite coating and the manufacturing method thereof in accordance with the present invention will be described.

The $MoSi_2$—$Si_3N_4$ composite coating in accordance with the present invention is coated on a surface of a base material made of molybden (Mo), molybden alloy, niobium coated by molybden, or niobium alloy coated by molybden, and thereby $Si_3N_4$ particles are distributed on an equiaxed $MoSi_2$ grain boundary.

Among $MoSi_2$—$Si_3N_4$ composite coatings, the micro-structure of $MoSi_2$ has an equiaxed grain structure, and accordingly, transmission of fine cracks which can be occurred by thermal stress caused by a difference between thermal expansion coefficients of the base material and the coating can be restrained.

Among $MoSi_2$—$Si_3N_4$ composite coatings, $Si_3N_4$ is primarily formed on the $MoSi_2$ grain boundary by limitation of solubility on the $MoSi_2$ matrix.

Also, the thermal expansion coefficient of $Si_3N_4$ is about $3\times10^{-6}$/° C. and accordingly, the thermal expansion coefficient ($9.5\times10^{-6}$/° C.) of pure $MoSi_2$ can be reduced to around that of the base material (Mo: $5.1\times10^{-6}$/° C., Nb: $7.2\times10^{-6}$/° C.), thus to improve cyclic oxidation resistance of the base material.

Also, the $Si_3N_4$ can be easily transformed into a $Si_2ON_2$ protection layer when oxygen is diffused into the grain through the grain boundary of $MoSi_2$ in an oxidation atmosphere, and prevent oxygen from diffusing inside through the $MoSi_2$ grain boundary, low-temperature oxidation resistance of the base material can be much better than that of the pure $MoSi_2$ coating. Such micro-structural property of the $MoSi_2$—$Si_3N_4$ composite coating can efficiently control oxygen diffusion through the grain boundary of $MoSi_2$ with relatively smaller amount of $Si_3N_4$ than in the case of the $MoSi_2$—$Si_3N_4$ sintered composite.

Also, the $Si_3N_4$ particles control growth of the $MoSi_2$ grain, and prevents degradation of the mechanical property of the coating by grain coarsening.

The manufacturing method of the $MoSi_2$—$Si_3N_4$ composite coating in accordance with the present invention includes the steps of (a) forming a $Mo_2N$ diffusion layer by vapor-depositing of nitrogen on the surface of the base material, (b) forming a $MoSi_2$—$Si_3N_4$ composite coating by vapor-depositing of silicon on the surface of the $Mo_2N$ diffusion layer.

In the above step (a), nitrogen is vapor-deposited on the surface of the base material which is maintained in a high-temperature hydrogen atmosphere by the CVD method, and nitrogen ($N_2$) or ammonia ($NH_3$) can be used when depositing nitrogen by the CVD method.

In this case, nitrogen which is deposited on the surface of the base material chemically react with the base material and forms a molybden nitride ($Mo_2N$) diffusion layer. As a deposition time passes, nitrogen which is deposited on the surfaces of the base material moves to a $Mo_2N$/Mo interface through the $Mo_2N$ layer and reacts with new molybden. Accordingly, the $Mo_2N$ layer is continuously generated and the thickness of the $Mo_2N$ layer increases in proportion to a square root of the deposition time. The thickness of the $Mo_2N$ layer varies according to the deposition temperature and time.

The growth rate of the $Mo_2N$ layer which was formed on the Mo base material at 1100° C. by chemical deposition of nitrogen can be disclosed as following Formula [1].

$$(\text{thickness of } Mo_2N \text{ layer})^2(cm^2)=7.82\times10^{-10}\times\text{time (sec)} \quad [1]$$

In the above step (b), after manufacturing the $Mo_2N$ layer having a predetermined thickness on the surface of the base material, silicon is vapor-deposited for a predetermined time using $SiCl_4$, $SiH_2Cl_2$, $SiH_3Cl$ or $SiH_4$ under the condition that the deposition temperature is maintained as it is.

In this case, a pack-siliconizing method which uses pack-siliconizing processing powder comprised of (1-70) wt % of Si, (1-10) wt % of NaF and (20-98) wt % of $Al_2O_3$ can be used for vapor-depositing of silicon.

When the deposited silicon is diffused into $Mo_2N$, $MoSi_2$ and $Si_3N_4$ are formed by a displacement reaction as shown in following Formula [2].

$$4Mo_2N+19Si\rightarrow8MoSi_2+Si_3N_4 \quad [2]$$

Since the nitrogen solubility limit in the $MoSi_2$, the $Si_3N_4$ particles which are formed by Formula (b) are formed in the $MoSi_2$ grain boundary.

Silicon which was deposited on the surface of the base material continuously moves into through the $MoSi_2$—$Si_3N_4$ composite coating and reacts with the $Mo_2N$ diffusion layer. Therefore, new grains of $MoSi_2$ and $Si_3N_4$ are formed to enable manufacturing of the $MoSi_2$—$Si_3N_4$ composite coating.

Since the thickness of the $MoSi_2$—$Si_3N_4$ composite coating increases in proportion to the square root of the vapor-deposition time of silicon, the deposition temperature and time for manufacturing a composite coating having a predetermined thickness can be calculated through reaction kinetics.

The growth rate of the $MoSi_2$—$Si_3N_4$ composite coating which was formed on the $Mo_2N$ layer at 1100° C. by vapor-deposition of Si can be disclosed as following Formula [3].

$$(\text{thickness of } MoSi_2+Si_3N_4 \text{ composite coating})^2 (cm^2)= 2.78\times10^{-9}\times\text{time (sec)} \quad [3]$$

On the other hand, as the other manufacturing method of the $MoSi_2$—$Si_3N_4$ composite coating in accordance with the present invention, the manufacturing method of the $MoSi_2$—$Si_3N_4$ composite coating includes the steps of (a) forming a $MoSi_2$ diffusion layer by vapor-depositing of silicon on the surface of the base material by the CVD method, (b) transforming the $MoSi_2$ diffusion layer into a $Mo_5Si_3$ diffusion layer by heating under a high-purity hydrogen or argon atmosphere, (c) forming a $Mo_2N$—$Si_3N_4$ composite diffusion layer by vapor-depositing of nitrogen on the surface of the $Mo_5Si_3$ diffusion layer by the CVD method, (d) forming a $MoSi_2$—$Si_3N_4$ composite coating by vapor-depositing of silicon on the surface of the $Mo_2N$—$Si_3N_4$ composite diffusion layer.

In the above step (a), silicon is vapor-deposited on the surface of the base material which is maintained in a high-temperature hydrogen atmosphere, by the CVD method for a predetermined time using $SiCl_4$, $SiH_2Cl_2$, $SiH_3Cl$ or $SiH_4$.

In this case, as the method for vapor-depositing of silicon, a pack-siliconizing method which uses the pack-siliconizing processing powder comprised of (1-70) wt % of Si, (1-10) wt % of NaF, and (20-98) wt % of $Al_2O_3$ can be used.

The $MoSi_2$ diffusion layer is manufactured on the surfaces of the base material by diffusing the reaction of silicon into the base material. In this case, the deposited silicon moves to the $MoSi_2$/Mo interface through the $MoSi_2$ diffusion layer and reacts with new molybden, thus to continuously generate the $MoSi_2$ layer. Therefore, the thickness of the $MoSi_2$ diffusion layer increases in proportion to the square root of the deposition time.

Therefore, the deposition temperature and time for manufacturing the $MoSi_2$ diffusion layer having a predetermined thickness can be calculated through reaction kinetics.

The growth rate of the $MoSi_2$ diffusion layer which was formed on the Mo layer at 1100° C. by vapor-deposition of Si can be disclosed as following Formula [4].

$$(\text{thickness of } MoSi_2 \text{ diffusion layer})^2(cm^2)=1.88\times10^{-9}\times\text{time(sec)} \quad [4]$$

In the above step (b), the $MoSi_2$ diffusion layer is transformed to the $Mo_5Si_3$ diffusion layer when the $MoSi_2$ diffusion layer is heated under a high-purity hydrogen or argon atmosphere after manufacturing the layer having a predetermined thickness.

In this case, temperature and time for completely transforming the $MoSi_2$ layer having a predetermined thickness into the $Mo_5Si_3$ layer can be calculated through reaction kinetics since the rate that the $MoSi_2$ is transformed into the $Mo_5Si_3$ depends upon a high diffusion rate of Si through the $Mo_5Si_3$ layer.

The transformation rate of the $MoSi_2$ diffusion layer into the Mo layer at 1200° C. can be disclosed following Formula [5].

$$(\text{thickness of } Mo_5Si_3 \text{ diffusion layer})^2(cm^2)=6.02\times10^{-11}\times\text{time(sec)} \quad [5]$$

In the above step (c), after the $MoSi_2$ diffusion layer is completely transformed to the $Mo_5Si_3$ diffusion layer, the supply of hydrogen is stopped again, and nitrogen is vapor-deposited on the surface of the $Mo_5Si_3$ diffusion layer by the CVD method using nitrogen or ammonia gas for a predetermined time.

In this case, when the deposited nitrogen is diffused into the $Mo_5Si_3$ diffusion layer, the $Mo_2N$ and $Si_3N_4$ are formed by a displacement reaction as in Formula [6].

$$2Mo_5Si_3+13N\rightarrow5Mo_2N+2Si_3N_4 \quad [6]$$

As nitrogen which is deposited on the surface of $Mo_2N$—$Si_3N_4$ continuously moves inside through the $Mo_2N$—$Si_3N_4$ composite diffusion layer, and reacts with the $Mo_5Si_3$ diffusion layer, forming new $Mo_2N$ and $Si_3N_4$ grains according to Formula [6], it is possible to manufacture the $Mo_2N$—$Si_3N_4$ composite diffusion layer.

Since thickness of the $Mo_2N$—$Si_3N_4$ composite diffusion layer increases in proportion to the square root of vapor-deposition time of nitrogen, deposition temperature and time for manufacturing a composite diffusion layer having a predetermined thickness can also be calculated through reaction kinetics.

The growth rate of the $Mo_2N$—$Si_3N_4$ composite diffusion layer which was formed on the $Mo_5Si_3$ base material at 1100° C. by chemical deposition of nitrogen can be disclosed as following Formula [7].

$$(\text{thickness of } Mo_2N\text{—}Si_3N_4 \text{ composite diffusion layer})^2(cm^2)=7.09\times^{-10}\times\text{time(sec)} \quad [7]$$

In the above step (d), silicon is vapor-deposited by the CVD method for a predetermined time using $SiCl_4$, $SiH_2Cl_2$, $SiH_3Cl$ or $SiH_4$ after manufacturing the $Mo_2N$—$Si_3N_4$ composite diffusion layer having a predetermined thickness.

In this case, as the method for vapor-depositing of silicon, a pack-siliconizing method which uses the pack-siliconizing processing powder comprised of (1-70) wt % of Si, (1-10) wt % of NaF, and (20-98) wt % of $Al_2O_3$ can be used.

In this case, when the deposited silicon is diffused into the $Mo_2N$—$Si_3N_4$ composite diffusion layer, the $MoSi_2$ and the $Si_3N_4$ are formed by a displacement reaction as in Formula [2], thus to manufacture the $MoSi_2$—$Si_3N_4$ composite coating on the surface of molybden.

Since the thickness of the $MoSi_2$—$Si_3N_4$ composite coating increases in proportion to the square root of vapor-deposition time of silicon, deposition temperature and time for manufacturing a composite coating having a predetermined thickness can also be calculated through reaction kinetics.

The growth rate of the $MoSi_2$—$Si_3N_4$ composite coating which was formed on the $Mo_2N$—$Si_3N_4$ composite diffusion layer at 1100° C. by vapor-deposition of Si can be disclosed as following Formula [8].

$$(\text{thickness of } MoSi_2+Si_3N_4 \text{ composite coating})^2(cm^2)= 1.03\times10-8\times\text{time (sec)} \quad [8]$$

On the other hand, comparison of the two manufacturing methods of the $MoSi_2$—$Si_3N_4$ composite coating (method 1 and method 2) will be described as follows.

In case the $MoSi_2$—$Si_3N_4$ composite coating is manufactured by the reaction of Formula [9] according to the method 1, the theoretical volume ratio of $Si_3N_4$ grain is calculated using the volume per a molecule of $MoSi_2$ (24.4 $cm^3$/mol) and $Si_3N_4$ (44.07 $cm^3$/mol), the ratio can be disclosed as follows.

$$4Mo_2N+19Si\rightarrow8MoSi_2+Si_3N_4 \quad [9]$$

$Si_3N_4$ vol %=(44.07)/(44.07+8∴24.4)×100=18.4%, and the volume ratio of $Si_3N_4$ which was experimentally formed is about 12.9~17.7%.

However, when nitrogen is chemically deposited on $Mo_5Si_3$ according to the method 2, $Mo_2N$ and $Si_3N_4$ are formed by the reaction of following Formula [10].

$$8Mo_5Si_3+52N\rightarrow20Mo_2N+8Si_3N_4 \quad [10]$$

When silicon is chemically deposited, $Mo_2N$ and Si forms $MoSi_2$ and $Si_3N_4$ by the reaction of following Formula [11].

$$20Mo_2N+95Si\rightarrow40MoSi_2+5Si_3N_4 \quad [11]$$

Therefore, the total generation reaction of the $MoSi_2$—$Si_3N_4$ composite coating which is formed by depositing nitrogen on the $Mo_5Si_3$ can be disclosed as in Formula [12].

$$8Mo_5Si_3+52N+95Si\rightarrow40MoSi_2+13Si_3N_4 \quad [12]$$

Therefore, in case the composite coating is manufactured using the $Mo_5Si_3$, the theoretical volume ratio of the $Si_3N_4$ amounts to $Si_3N_4$ vol %=(13×44.07)/(13×44.07+40×24.4)×100=37%.

However, the volume ratio which was experimentally measured is about 30~33%. Therefore, in case the composite coating is manufactured using the $Mo_5Si_3$, the volume ratio of the $Si_3N_4$ becomes about 30~33%. The thermal expansion coefficient of molybden and the composite coating become almost identical, and as the result, cracks are not formed in the composite coating.

Example 1

In Example 1, the $MoSi_2$—$Si_3N_4$ composite coating was manufactured by the method 1, and the purity of molybden used in Example 1 is 99.95%. The purity of niobium is 99.9% and each of the material is formed as a plate of 10 mm×10 mm×1 mm size.

After grinding molybden and niobium test pieces successively using SiC papers and 1 μm diamond paste, the above materials are washed in the supersonic washer with acetone, alcohol and distilled water respectively for 10 minutes to remove organic material which can exist on the surface. The resultant material was dried and was used as a base material for coating.

Particularly, in case of the niobium test piece, the test piece which was formed by depositing molybden on the surface of the pre-processed niobium in the thickness of about 30 μm using the DC magnetron sputtering device was used as the base material of the Example. During deposition, the pressure of argon inside the reaction chamber was maintained as about 1~20 m torr.

Nitrogen and silicon are inserted in a quartz reaction tube for chemical vapor-deposition on the surface of the pre-processed molybden and niobium, and oxygen in the reaction tube is removed by introducing high-purity argon gas (99.9999%). As introducing high-purity hydrogen (99.9999%) or high-purity argon at a rate of 100~2,000 cm/min, the materials are heated to 800~1400° C. at a heating rate of 5~20° C./min, and metallic oxides which can exist in the metal surfaces of the metals are reduced. To stabilize the deposition temperature, the temperature was maintained for about 10~20 minutes and the supply of hydrogen was stopped. Then, nitrogen is deposited on the metallic surfaces for about 10 minutes~20 hours supplying ammonia gas at a flow rate of 3~2,000 cm/min Nitrogen deposited on the surface of the base material reacts chemically with molybden and forms a compound layer of the $Mo_2N$ composition. As the deposition time passes, nitrogen deposited on the surface of the metals moves to the $Mo_2N$/Mo interface through the $Mo_2N$ layer and continuously generates $Mo_2N$ by reacting with new molybden. The $Mo_2N$ layer grows in proportion to the square root of the deposition time.

Therefore, the deposition temperature and time for manufacturing the $Mo_2N$ layer having a predetermined thickness can be calculated through reaction kinetics. As an example, when nitrogen is chemically vapor-deposited at the deposition temperature of 1100° C. for about 2 hours, $Mo_2N$ diffusion layer having a thickness of about 24 μm grows on the molybden metal surface.

After manufacturing the $Mo_2N$ diffusion layer having a predetermined thickness, the supply of ammonia gas is stopped, and the ammonia gas which is remained inside the reaction tube by supplying hydrogen to the reaction tube for 1~30 minutes at a flow rate of 30~3,000 cm/min. Silicon is chemically vapor-deposited on the surface of the $Mo_2N$ diffusion layer for 30 minutes~30 hours while supplying silicon tetrachloride gas and hydrogen to the reaction tube to have the total flow rate of the two gases as about 30~4,000 cm/min and the flow rate ratio as about 0.005~0.5.

The deposited silicon forms the $MoSi_2$ and $Si_3N_4$ by displacement reaction with the $Mo_2N$. As the deposition time passes, the deposited silicon continuously moves into through the $MoSi_2$—$Si_3N_4$ composite coating, and reacts with the $Mo_2N$ diffusion layer. Accordingly new $MoSi_2$ grain and $Si_3N_4$ grain are formed, and the $MoSi_2$—$Si_3N_4$ composite coating can be formed.

Since the thickness of the $MoSi_2$—$Si_3N_4$ composite coating increases in proportion to the square root of the vapor-deposition time, the deposition temperature and time for manufacturing the composite coating of a predetermined thickness can be calculated through reaction kinetics. As an example, a $MoSi_2$—$Si_3N_4$ composite coating having a thickness of 70 μm which is excellent in oxidation resistance and corrosion resistance can be formed on the surfaces of molybden and niobium by chemically vapor-depositing silicon on the surface of the $Mo_2N$ diffusion layer for 5 hours at the deposition temperature of 1100° C. and by having it reaction-diffused into the $Mo_2N$.

After forming the composite coating, high-purity hydrogen gas or high-purity argon gas are flowed at a flow rate of 100~2,000 cm/min and the coating was furnace-cooled to the room temperature.

On the other hand, high-purity solutions, which are used in the field of semiconductor, were used as hydrogen and silicon tetrachloride gases in Example 1 of the present invention. Particularly, in the present invention, since the vaporization temperature of the silicon tetrachloride gas is about 54° C., silicon was supplied to the reaction tube by bubbling using hydrogen gas after injecting the silicon tetrachloride solution into a bubbler which was maintained at constant temperature of 0~30° C. In the present invention, the chemical vapor-deposition was performed in a tube furnace in which a reaction tube manufactured with a quartz tube having an inner diameter of 20 mm.

Figure 2A:
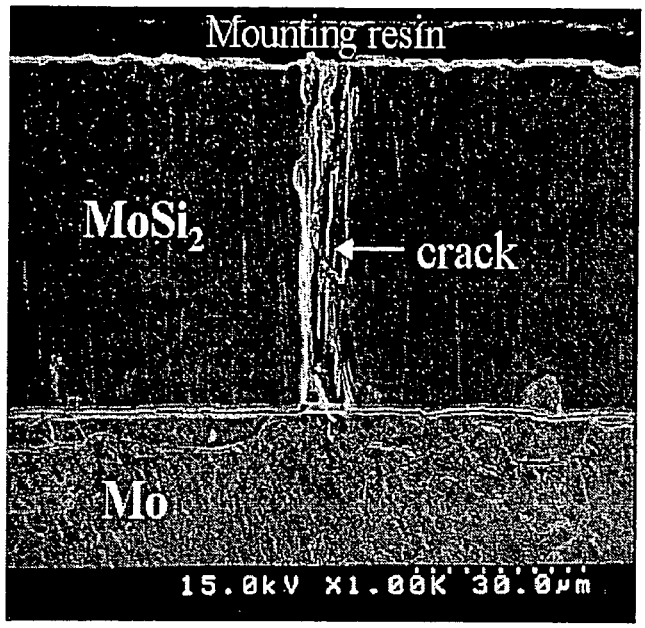
Figure 2B:
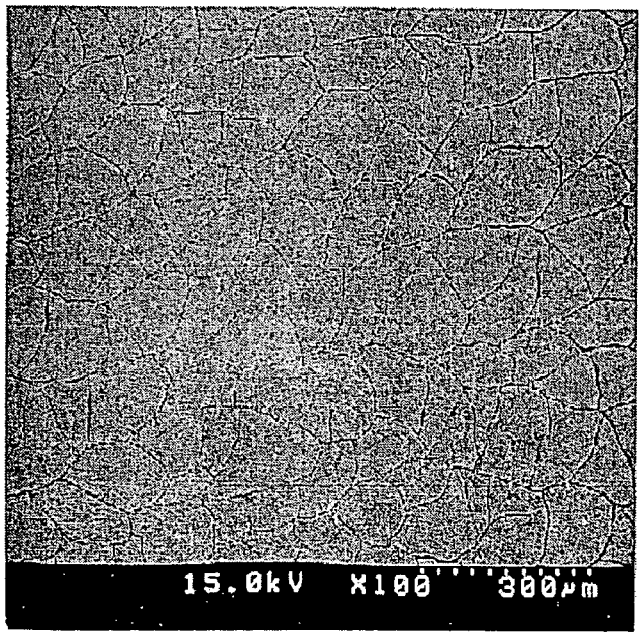
Figure 3A:
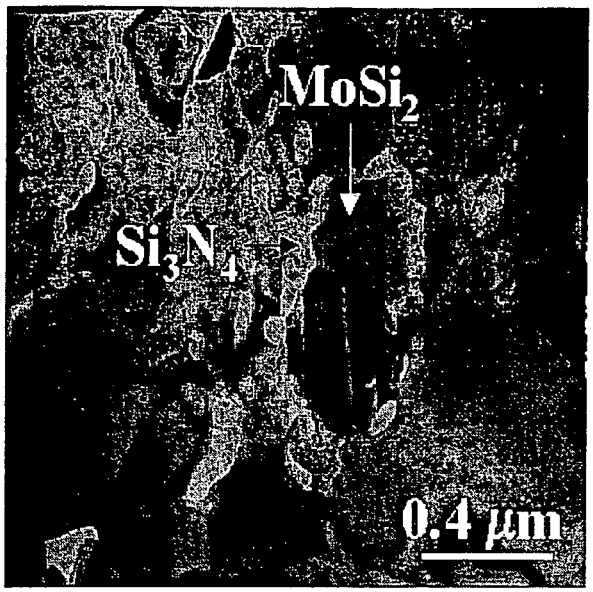
FIGS. 3*a* and 3*b* are views showing a cross-sectional structure and a surface structure of a $MoSi_2$—$Si_3N_4$ composite coating which was formed by a manufacturing method of a first embodiment of the present invention.
Figure 3B:
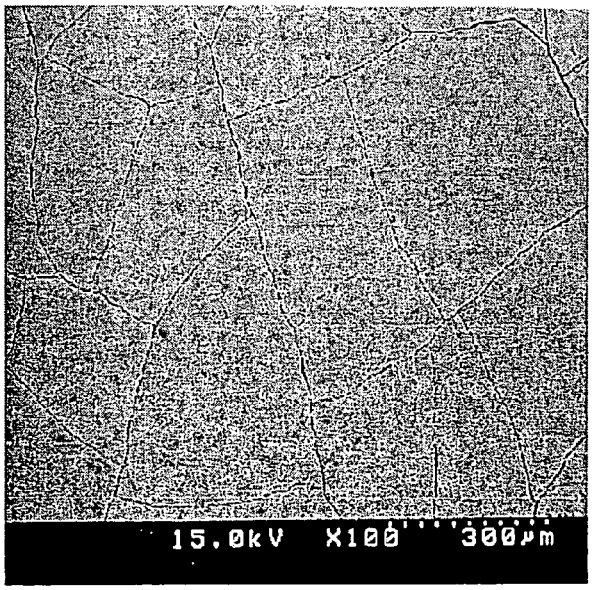

FIGS. 2A and 2B are views showing a cross-sectional structure and a surface structure of the $MoSi_2$ coating having a columnar structure which was manufactured by the CVD method, pack-siliconizing method, dipping method and the like respectively which are conventional methods for processing the surface to process the surface of the base material, FIGS. 3A and 3B are views showing a cross-sectional structure and a surface structure of the $MoSi_2$—$Si_3N_4$ composite coating which was formed by the manufacturing method of the $MoSi_2$—$Si_3N_4$ composite coating in accordance with the present invention.

FIG. 3A is a view showing a result that the sectional microstructure of the $MoSi_2$—$Si_3N_4$ composite coating manufactured by the method 1 of Example 1 was observed with a transmission electron microscope (TEM), and FIG. 3B is a view showing a result that the surface structure of the composite coating was observed with a back scattering SEM.

On the other hand, the $MoSi_2$ coating which was manufactured by depositing silicon on the molybden base material by the CVD method which is the conventional surface-processing method and the $MoSi_2$—$Si_3N_4$ composite coating manufactured by the method 1 of Example 1 in accordance with the present invention will be compared with each other.

As shown in FIGS. 3A and 3B, ultra micro $Si_3N_4$ is precipitated on the equiaxed grain $MoSi_2$ grain boundary in the $MoSi_2$—$Si_3N_4$ composite coating manufactured by the method 1 in Example 1 in accordance with the present invention. The average grain size of the equiaxed grain $MoSi_2$ calculated by an image analyzer is about 0.5~0.3 μm. The average size and volume ratio of the $Si_3N_4$ precipitates were about 80~120 nm and 12.9~17.7%.

Also, as the $Si_3N_4$ particles are mainly formed in the $MoSi_2$ grain boundary, growth of the $MoSi_2$ grains is restrained, and accordingly, manufacturing of the equiaxed grain $MoSi_2$ coating having an average grain size of about 0.5~0.3 μm is enabled.

On the other hand, the $MoSi_2$ coating which was manufactured by depositing silicon by the CVD method which is the conventional surface-processing method has a columnar structure as shown in FIGS. 2A and 2B.

Particularly, as shown in FIGS. 2*b* and 3*b*, in the $MoSi_2$—$Si_3N_4$ composite coating which was manufactured by the method 1 in Example 1 in accordance with the present invention, when the surface of the coating is observed with a back scattered SEM, was calculated. As the result, the number of the cracks in a unit length was about 50 ea/cm showing 64% of decrease from 140 ea/cm for the conventional coating.

Since the thermal expansion coefficient of the $MoSi_2$-(12.9~17.7 vol. %) $Si_3N_4$ composite coating, is higher than that of Mo which is the base material, a tensile stress is at work in the composite coating in case of cooling from the deposition temperature to the room temperature. Therefore, the crack could not be completely removed.

Example 2

In Example 2, the $MoSi_2$—$Si_3N_4$ composite coating was manufactured by the method 1 among the manufacturing methods of the $MoSi_2$—$Si_3N_4$ composite coating.

As in Example 1, after manufacturing a $Mo_2N$ diffusion layer having a thickness of about 20 μm in the surface of molybden and niobium metals, the resultant material is furnace-cooled to the room temperature while introducing high-purity hydrogen or high-purity argon at a flow rate of 100~2,000 cm/min.

On the other hand, contrary to Example 1, molybden and niobium metals coated by the $Mo_2N$ diffusion layer having a predetermined thickness are embedded in a mixture powder in a composition of (1~70) wt % of Si, (1~10) wt % of NaF, and (20~98) wt % of $Al_2O_3$ and then inserted in a reaction tube for pack-siliconizing.

By introducing high-purity argon gas, oxygen in the reaction tube was removed, and the reaction tube is heated to 800~1400° C. at a heating rate of 5~20° C./min while introducing high-purity hydrogen or high-purity argon at a flow rate of 100~2,000 cm/min. The deposited silicon reacts with $Mo_2N$ layer on the metal surface by maintaining the temperature for 30 minutes~30 hours.

After manufacturing the $MoSi_2$—$Si_3N_4$ composite coating on the metal surface, the metal is furnace-cooled to the room temperature while introducing high-purity hydrogen or high-purity argon at a flow rate of 100~2,000 cm/min.

Since the thickness of the $MoSi_2$—$Si_3N_4$ composite coating which was manufactured by the pack-siliconizing method increases in proportion to the square root of the silicon deposition time as in the chemical deposition, the deposition temperature and time for manufacturing a composite coating having a specific thickness can be expected through reaction kinetics.

A powder, which was manufactured by mixing 30 g of the powder comprised of (1~70) wt % of Si, (1~10) wt % of NaF, and (20~98) wt % of $Al_2O_3$ for 24 hours using a mixer which can perform rotation and upper and lower movements simultaneously, was used as the pack-siliconizing processing powder. The used silicon powder has a purity of 99.5% and an average grain size of 325 mesh, a NaF reagent was used as an activator, and high-purity alumina of an average size of 325 mesh was used as a filler.

Pack-siliconizing which is performed at lower than 1100° C. was performed in a tube furnace in which the reaction tube having the inner diameter of 60 mm, which was manufactured with an inconel 600, is mounted, and in case of higher than 1200° C., a high-purity alumina tube was used. The mixed pack-siliconizing processing powder was filled in an alumina crucible of 40 cc, molybden or niobium metal coated by the $Mo_2N$ diffusion layer is embedded at the center, and then the tube was enclosed by the alumina cover.

Example 3

In Example 3 the $MoSi_2$—$Si_3N_4$ composite coating was manufactured by the method 2 among the manufacturing methods of the $MoSi_2$—$Si_3N_4$ composite coating in accordance with the present invention.

As in Example 1, after heating the molybden and niobium metals to the deposition temperature, and fixing a total flow rate of two gases to become about 30~4,000 cm/min while a flow rate ratio of silicon tetrachloride gas and hydrogen becomes about 0.005~0.3, silicon is chemically vapor-deposited on the metal surface for 10 minutes~30 hours by supplying the gases to the reaction tube. Accordingly, the $MoSi_2$ diffusion layer is manufactured on the surface of the molybden and niobium metals as silicon diffuses into Mo.

In this case, the deposited silicon moves to a $MoSi_2$/Mo interface through the $MoSi_2$ diffusion layer, reacts with new molybden, thus to continuously generate the $MoSi_2$ layer. Therefore, since the thickness of the $MoSi_2$ diffusion layer increases in proportion to the square root of the silicon deposition time, the deposition temperature and time for manufacturing a $MoSi_2$ diffusion layer having a specific thickness can be expected through reaction kinetics. As an example, when silicon is chemically vapor-deposited at the deposition temperature of 1100° C. for 30 minutes, the $MoSi_2$ diffusion layer having a thickness of about 18 μm grows on the surface made of molybden or niobium metals.

After manufacturing the $MoSi_2$ diffusion layer having a thickness of about 18 μm, supply of silicon tetrachloride gas is stopped, and then the layer is heated to 1200° C. at a heating rate of 5~20° C./min while supplying hydrogen to the reaction tube at a flow rate of 100~2,000 cm/min. When the temperature is maintained for 70 hours, the $MoSi_2$ diffusion layer having a thickness of about 18 μm is transformed to the $Mo_5Si_3$ diffusion layer having a thickness of about 34 μm.

In this case, the $MoSi_2$ diffusion layer can be transformed to the $Mo_5Si_3$ diffusion layer in a hydrogen atmosphere at 1100° C., but since it takes much time to transform, it is desirable that the diffusion heating temperature is raised to 1200° C. In case the reaction tube is alumina, since the temperature of the material can be raised to a high temperature, heating time for transforming the $MoSi_2$ diffusion layer into the $Mo_5Si_3$ diffusion layer can be substantially reduced.

After the $MoSi_2$ diffusion layer is completely transformed into the $Mo_5Si_3$ diffusion layer, the temperature is decreased to the deposition temperature of 1100° C. at a cooling rate of 5~20° C./min again.

Next, nitrogen is chemically vapor-deposited on the surface of the $Mo_5Si_3$ diffusion layer for 10 hours while supplying ammonia gas into the reaction tube at a flow rate of 3~2,000 cm/min after stopping the supply of hydrogen, and accordingly, a $Mo_2N$—$Si_3N_4$ diffusion layer having a thickness of about 50 μm is manufactured on the surface of molybden or niobium metals.

After removing ammonia gas which is remained inside the reaction tube by supplying hydrogen into the reaction tube at a flow rate of 30~3,000 cm/min for 1~30 minutes, silicon is chemically vapor-deposited on the metal surface for about an hour and when silicon is diffused into of the $Mo_2N$—$Si_3N_4$ diffusion layer, the silicon reacts with the $Mo_2N$. Accordingly, the $MoSi_2$ and $Si_3N_4$ are formed, and a $MoSi_2$—$Si_3N_4$ composite coating having a thickness of 60 μm which is excellent in oxidation resistance and corrosion resistance was manufactured on the surface of molybden and niobium metals.

In case of Example 3, since the thickness of the manufactured $MoSi_2$—$Si_3N_4$ composite coating increases in proportion to the square root of the silicon deposition time, the deposition temperature and time for manufacturing a composite coating having a predetermined thickness can be calculated through reaction kinetics.

Figure 4A:
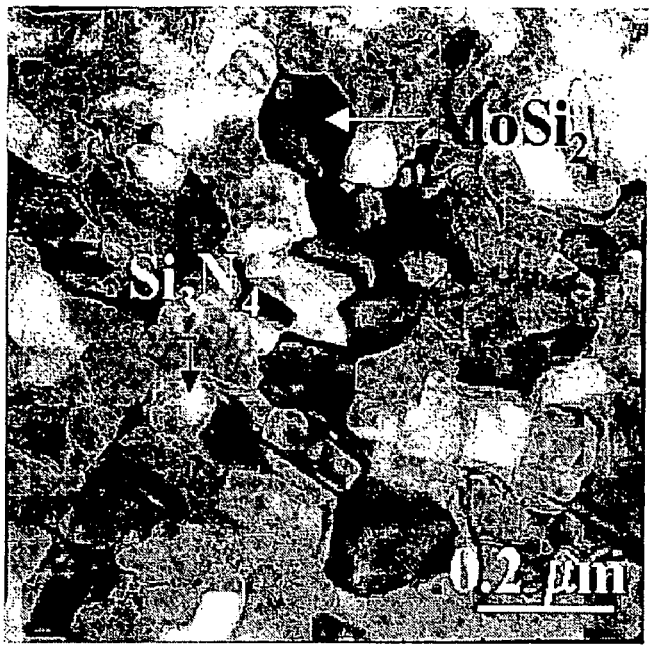
FIGS. 4*a* and 4*b* are views showing a cross-sectional structure and a surface structure of the $MoSi_2$—$Si_3N_4$ composite coating which was formed by a manufacturing method of a second embodiment of the present invention.

FIG. 4A shows a result that the cross-sectional microstructure of the $MoSi_2$—$Si_3N_4$ composite coating which was manufactured by the above method is observed by a TEM.

Figure 4B:
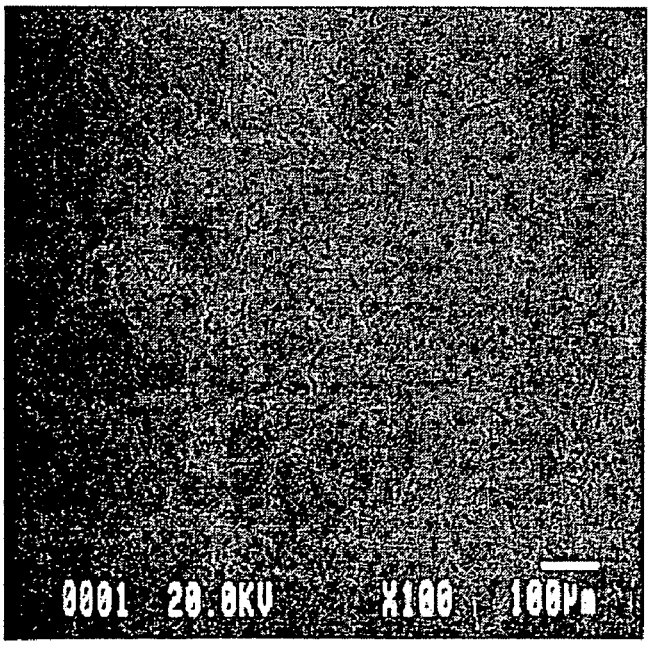

FIG. 4B is a view showing a result that the surface of the composite coating is observed by a back scattered scanning electron microscope (SEM) and shows that super-micro $Si_3N_4$ is precipitated on the equiaxed $MoSi_2$ grain boundary. The average grain size which is calculated with an image analyzer is about 90 nm and the volume ratio and the average size of the $Si_3N_4$ particles were about 60 nm and 30~33%.

Contrary to a surface structure (FIG. 2B) of the $MoSi_2$ coating manufactured by depositing silicon on the molybden base material by the chemical vapor-deposition method, and a surface structure (FIG. 3B) of the $MoSi_2$—$Si_3N_4$ composite coating which is manufactured by the method of Example 1, in case of the surface structure (FIG. 4B) of the $MoSi_2$—$Si_3N_4$ composite coating which was manufactured by the method of Example 3, the cracks were not observed on the surface of the coating.

Example 4

The $Mo_5Si_3$ coating having a thickness of about 35 μm is manufactured on the surface of molybden and niobium metals by a method which is identical as Example 3, and the coating is furnace-cooled to the room temperature while introducing high-purity hydrogen or high-purity argon at a flow rate of 100~2,000 cm/min.

The $MoSi_2$—$Si_3N_4$ composite coating which is excellent in oxidation resistance and corrosion resistance is manufactured on the surface of molybden and niobium metals by vapor-depositing silicon with the pack-siliconizing method identical as Example 2, and the coating is furnace-cooled to the room temperature while flowing high-purity hydrogen or high-purity argon at a flow rate of 100~2,000 cm/min.

Since the thickness of the $MoSi_2$—$Si_3N_4$ composite coating which was manufactured according to Example 4 also increases in proportion to the square root of the silicon deposition time, the deposition temperature and time for manufacturing the composite coating having a predetermined thickness can be calculated through reaction kinetics.

A cyclic oxidation resistance and low-temperature oxidation resistance are compared between a simple $MoSi_2$ coating and a $MoSi_2$—$Si_3N_4$ composite coating as follows.

Comparison Example 1

Cyclic oxidation resistance tests were performed by using molybden coated by a $MoSi_2$ layer having a thickness of 50 μm and a molybden test piece including a $MoSi_2$—$Si_3N_4$ composite coating having a thickness of 60 μm which was manufactured according to Example 3.

In the cyclic oxidation resistance test, the two test pieces are put on the alumina boat, they are inserted in the heating unit using an automatic feeding apparatus in a rotary kiln which was pre-heated to 1300° C. in the air, and the material is heated for 55 minutes and air-cooled for 30 minutes. The above process was tested as 1 time, and the cyclic oxidation resistance was estimated according to weight change per a unit surface area for every predetermined number of time using an electronic scale having a resolving power of $10^{-5}$ g.

As the result of the estimation, in case of molybden coated by the $MoSi_2$ layer, about 20 mg/cm$^2$ of weight loss was observed after about 20 times of cyclic oxidation tests, but in case of the molybden test piece on which the $MoSi_2$—$Si_3N_4$ composite coating is formed, about 0.35 mg/cm$^2$ of weight-increase was observed after about 300 times of the cyclic oxidation tests.

Therefore, in case of molybden coated by the $MoSi_2$ layer, oxygen which has easily diffused through cracks formed in a coating after a very short cyclic oxidation test reacts with molybdenum to be volatilized into $MoO_3$. Accordingly, rapid weight loss is observed, but in case of molybdenum on which the $MoSi_2$—$Si_3N_4$ composite coating is formed, since oxygen can not diffused into the coating even after about 300 times of cyclic oxidation tests, oxidation is proceeded only on a surface of a composite coating which is exposed in the air, a small amount of weight increase is observed.

Comparison Example 2

A low-temperature oxidation resistant test was performed using molybdenum on which the $MoSi_2$ layer having a thickness of 50 μm is coated, and a molybdenum test piece on which the $MoSi_2$—$Si_3N_4$ composite coating having a thickness of 60 μm is formed.

In the low-temperature oxidation resistant test, the two test pieces are put on the alumina boat, they are inserted in the heating unit using an automatic feeding apparatus in a rotary kiln which was pre-heated to 500° C. in the air, and the material is heated for 55 minutes and air-cooled for 5 minutes. The above process was tested as 1 time, and the low-temperature oxidation resistance was estimated according to the degree of powderization by observing the surface of the test piece which pass the low-temperature oxidation using an optical microscope.

In case of molybden coated by the $MoSi_2$ layer, it could be observed that a amount of $MoO_3$ and $SiO_4$ powders which are products of the low-temperature oxidation reaction are formed on the surface of the coating after about 50 times of low-temperature oxidation tests. However, in case of the molybden test piece on which the $MoSi_2$—$Si_3N_4$ composite coating is formed, the product of the low-temperature is hardly observed on the surface of the coating even after about 1,000 times of low-temperature oxidation tests.

The present invention can provide a $MoSi_2$—$Si_3N_4$ composite coating having a new structure by forming the $Si_3N_4$ particles in the $MoSi_2$ grain boundary which indicates a microstructure in the shape of the equiaxed grain in the surface of the base material using the chemical vapor-deposition method and the pack-siliconizing method among diffusion methods which have excellent advantages of simplicity, economic efficiency, and an excellent interface-binding force of the base material and the coating.

The $MoSi_2$—$Si_3N_4$ composite coating can reduce the difference of thermal expansion coefficients between the composite coating and the base material, and completely restrain formation of the fine cracks inside the composite coating, thus to improve cyclic oxidation resistance. The present invention can also restrain diffusion of oxygen through the grain boundary due to the $Si_3N_4$ particles formed in the $MoSi_2$ grain boundary, and the low-temperature oxidation resistance can be also improved, thus to improve the mechanical property of the coating by grain refining (restraining of transmission of the fine crack by thermal stress).

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A manufacturing method of a $MoSi_2$—$Si_3N_4$ composite coating which is coated on molybden (Mo), molybden alloy, niobium coated by molybden, or niobium alloy coated by niobium or molybden, comprising the steps of:

forming a $MoSi_2$ diffusion layer by vapor-depositing of silicon on a surface of a base material by the CVD method;

transforming the $MoSi_2$ diffusion layer into a $Mo_5Si_3$ diffusion layer by heating under a high-purity hydrogen or argon atmosphere;

forming a $Mo_2N$—$Si_3N_4$ composite diffusion layer by vapor-depositing of nitrogen on the surface of the $Mo_5Si_3$ diffusion layer by the CVD method; and forming a $MoSi_2$—$Si_3N_4$ composite coating by vapor-depositing of silicon on the surface of the $Mo_2N$—$Si_3N_4$ composite diffusion layer.

2. The method of claim 1, wherein the method for vapor-depositing of nitrogen on a surface of the $Mo_5Si_3$ diffusion layer in the step (c) is a CVD method using nitrogen ($N_2$) or ammonia ($NH_3$).

3. The method of claim 1, wherein the method for vapor-depositing of silicon on the surface of the base material in the step (a) is a CVD method using $SiCl_4$, $SiH_2Cl_2$, $SiH_3Cl$ or $SiH_4$.

4. The method of claim 3, wherein the method for vapor-depositing of nitrogen on the surface of the $Mo_5Si_3$ diffusion layer in the step (c) is a CVD method using nitrogen ($N_2$) or ammonia ($NH_3$).

5. The method of claim 1, wherein the method for vapor-depositing of silicon on a surface of the base material in the step (a) is a pack-siliconizing method using pack-siliconizing processing powder having a composition of (1-70) wt % of Si, (1-10) wt % of NaF and (20-98) wt % of $Al_2O_3$.

6. The method of claim 5, wherein the method for vapor-depositing of nitrogen on the surface of the $Mo_5Si_3$ diffusion layer in the step (c) is a CVD method using nitrogen ($N_2$) or ammonia ($NH_3$).

7. The method of claim 1, wherein the method for vapor-depositing of silicon on the surface of the $MoSi_2$—$Si_3N_4$ composite diffusion layer in the step (d) is a CVD method using $SiCl_4$, $SiH_2Cl_2$, $SiH_3Cl$ or $SiH_4$.

8. The method of claim 1, wherein the method for vapor-depositing of silicon on the surface of the composite diffusion layer in the step (d) is a pack-siliconizing method using pack-siliconizing processing powder having a composition of (1-70) wt % of Si, (1-10) wt % of NaF and (20-98) wt % of $Al_2O_3$.

* * * * *